United States Patent [19]

Hatano et al.

[11] Patent Number: 5,043,532

[45] Date of Patent: Aug. 27, 1991

[54] INTEGRAL TYPE AIR CONDITIONER

[75] Inventors: Koji Hatano, Kusatsu; Mitsuo Nakanuma, Shiga Prefecture; Tatuhiro Kobayashi, Kusatsu, all of Japan

[73] Assignee: Matsushita Electric Industrial Co., Ltd., Kadoma, Japan

[21] Appl. No.: 417,771

[22] Filed: Oct. 6, 1989

[30] Foreign Application Priority Data

Oct. 7, 1988 [JP] Japan ..... 63-254041

[51] Int. Cl.[5] ..... H05K 5/00; H02B 5/00

[52] U.S. Cl. ..... 174/52.1; 361/331

[58] Field of Search ..... 361/331, 332, 334, 346, 361/338, 339, 391, 422; 174/521.1, 50; 62/262

[56] References Cited

U.S. PATENT DOCUMENTS

| | | | |
|---|---|---|---|
| 3,012,172 | 12/1961 | Kammer et al. | 361/394 |
| 3,036,146 | 5/1962 | Kamen | 174/69 |
| 3,142,003 | 7/1964 | Olashaw | 361/338 |
| 4,153,310 | 5/1979 | Loving et al. | 312/108 |

*Primary Examiner*—Leo P. Picard
*Assistant Examiner*—Bot Lee Ledynh
*Attorney, Agent, or Firm*—Cushman, Darby & Cushman

[57] ABSTRACT

A control box 6 of an air conditioner at the front part of the body has two compartments 6A, 6B parted by a partition plate 7. One compartment 6A is for receiving lead wires 2 which connect electric components with a compressor motor and a fan motor, and the other compartment 6B is for containing electric parts. The lead wires 2 are folded once in the compartment 6A. and again folded at the rear end of the partition plate 7. By such twice folding of the lead wires and cramping them at the rear end of the partition plate 7, damaging of electric components by the lead wires is prevented.

8 Claims, 6 Drawing Sheets

INTEGRAL TYPE AIR CONDITIONER

FIELD OF THE INVENTION AND RELATED ART STATEMENT

1. Field of the Invention

The present invention relates to a box-shaped, integral type or similarly shaped air conditioner wherein several kinds of electric components, lead wires and connections members thereof are contained in a control box.

2. Description of the Related Art

A structure of a conventional control box of a box-shaped air conditioner is shown in FIG. 4. Numeral 1 designates a body of the box-shaped air conditioner, wherein lead wires 2 to a compressor and a fan motor are contained. These lead wires 2 from the compressor and the fan are led into an interior of a control box 6 through a hole 4 bored through a bulkhead 3. The wires are connected with terminals provided in the control box 6.

The control box 6 is to be drawn out from the front end of the body 1, each time maintenance needs to be done and/or regulation of the circuit is required. Thus lead wires 2 are provided with sufficient length to allow outward drawing of the control box 6. Numeral 21 designates a frame of the body 1.

The above-mentioned conventional control box 6 has the below-mentioned shortcomings. In the control box 6 the lead wires 2 of considerable length are provided, and hence easily tangle, when the control box 6 is put into or taken out of the body 1. These lead wires 2 further are caught with some electric components 22, and damage them or break interconnections of some lead wire ends of the electric components. Furthermore, anyone who draws out or puts in the control box 6 must concentrate what great attention to prevent damage of the component or disconnection of lead wires, thus resulting in long service times.

OBJECT AND SUMMARY OF THE INVENTION

The object of the present invention is to solve the above-mentioned shortcomings and obtain a control box which does not damage the electric component nor disconnect the lead wires, and therefore enables higher efficiency in maintenance, repair or adjustment. These objects are accomplished by an air conditioner comprising a control box which is provided in a manner to be drawn out from the front end of a body, wherein the control box comprises:

an electric component compartment for containing electric components therein, a lead wire compartment for containing lead wires connected to the electric components and having opening at least at the rear side, and a partition provided to part the electric component compartment and the lead wire compartment.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 2(*a*) is an enlarged perspective view of the clamp member 8 in FIG. 2.

FIG. 3(*b*) is a plan view of the control box which is taken off from the body of the air conditioner.

It will be recognized that some or all of the Figures are schematic representations for purposes of illustration and do not necessarily depict the actual relative size or location of the elements shown.

DESCRIPTION OF THE PREFERRED EMBODIMENTS

Figure 1:
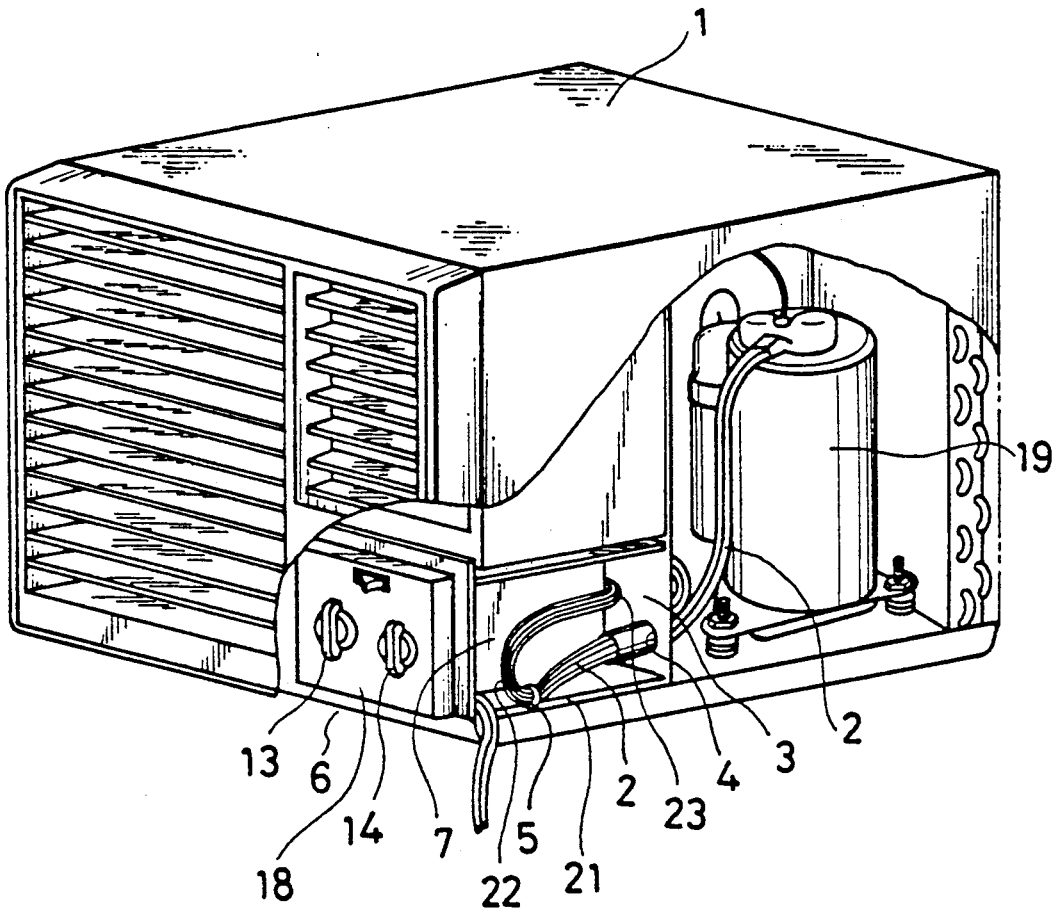
FIG. 1 is a perspective view partly in section of an box-shaped air conditioner having a control box which is a first embodiment of the invention.
Figure 2:
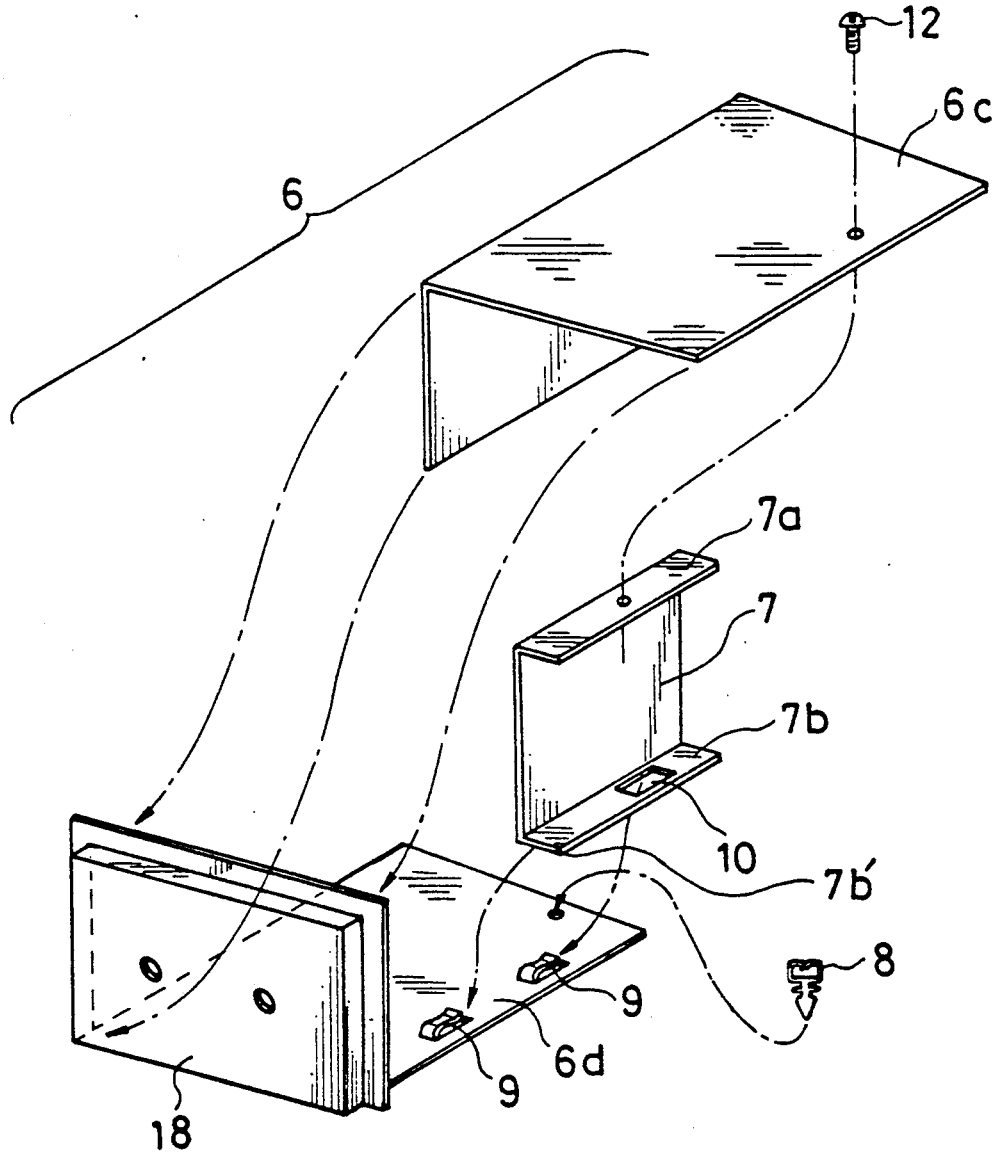
FIG. 2 is an exploded perspective view of the control box.
Figure 2A:
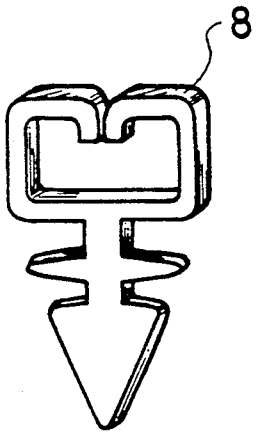
Figure 3:
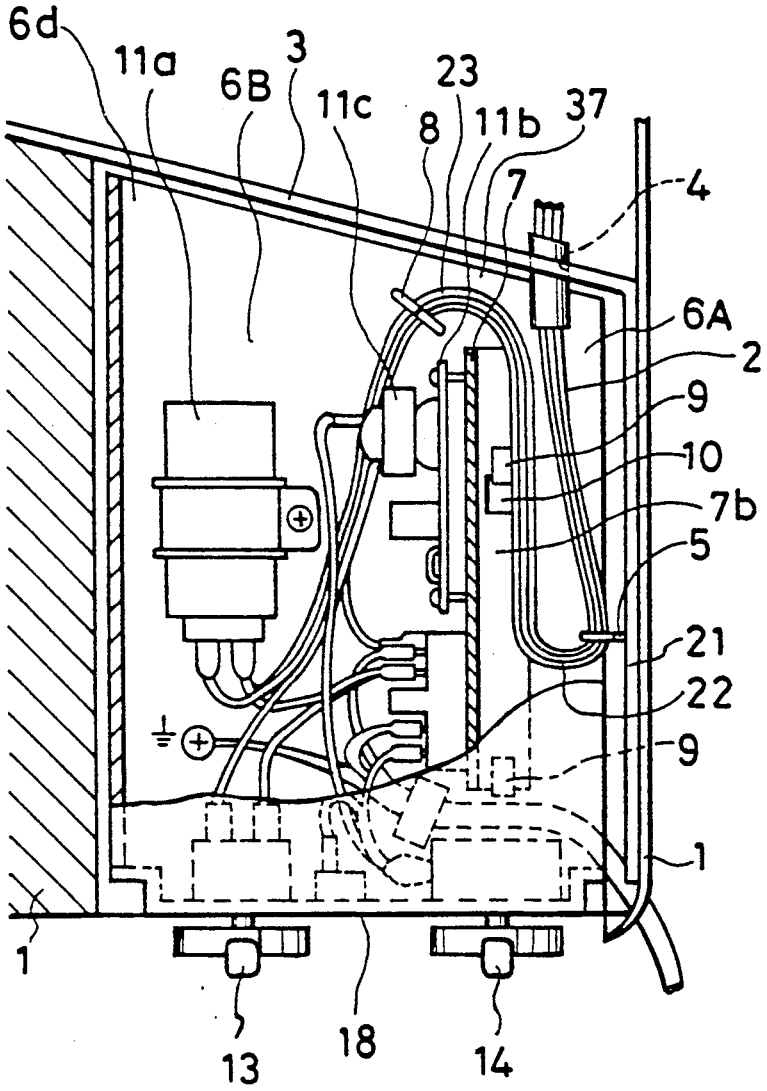
FIG. 3(*a*) is a plan view of the control box which is set in the body of the air conditioner.
Figure 3:
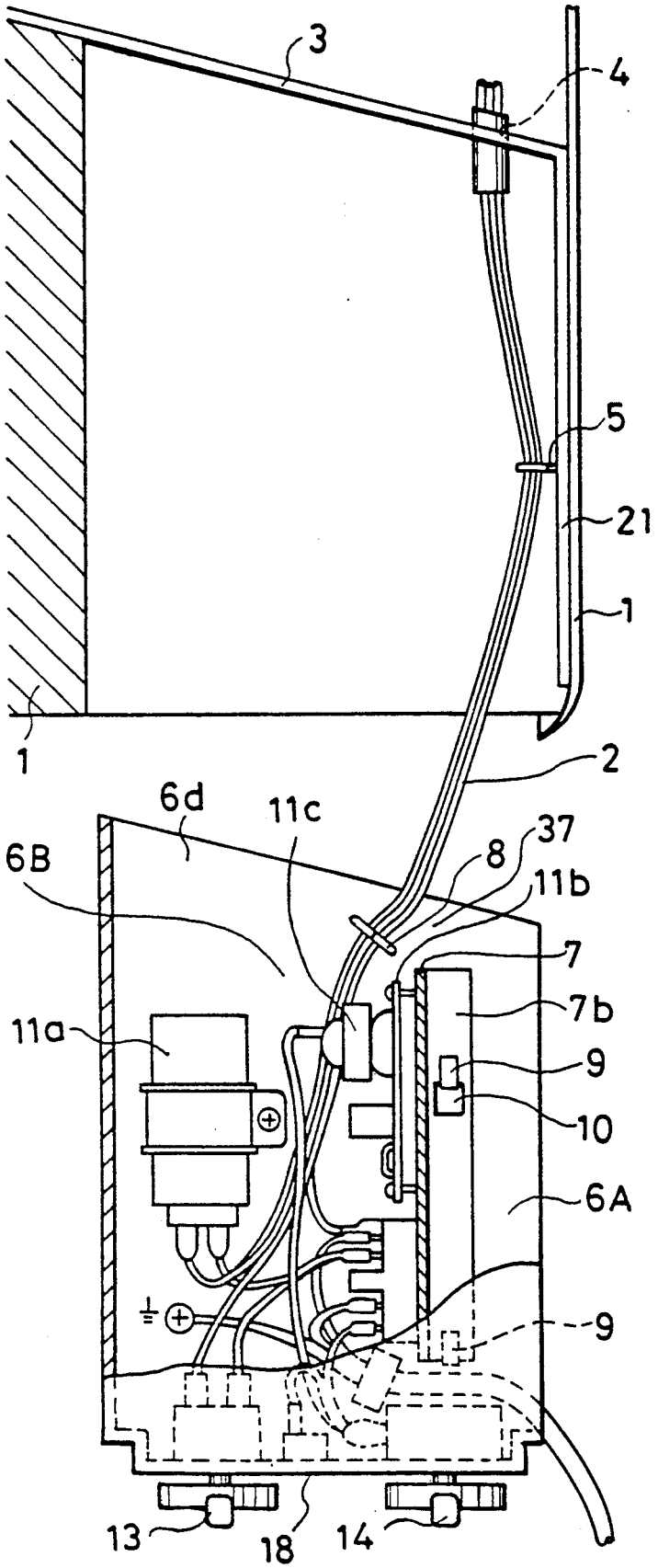
Figure 4:
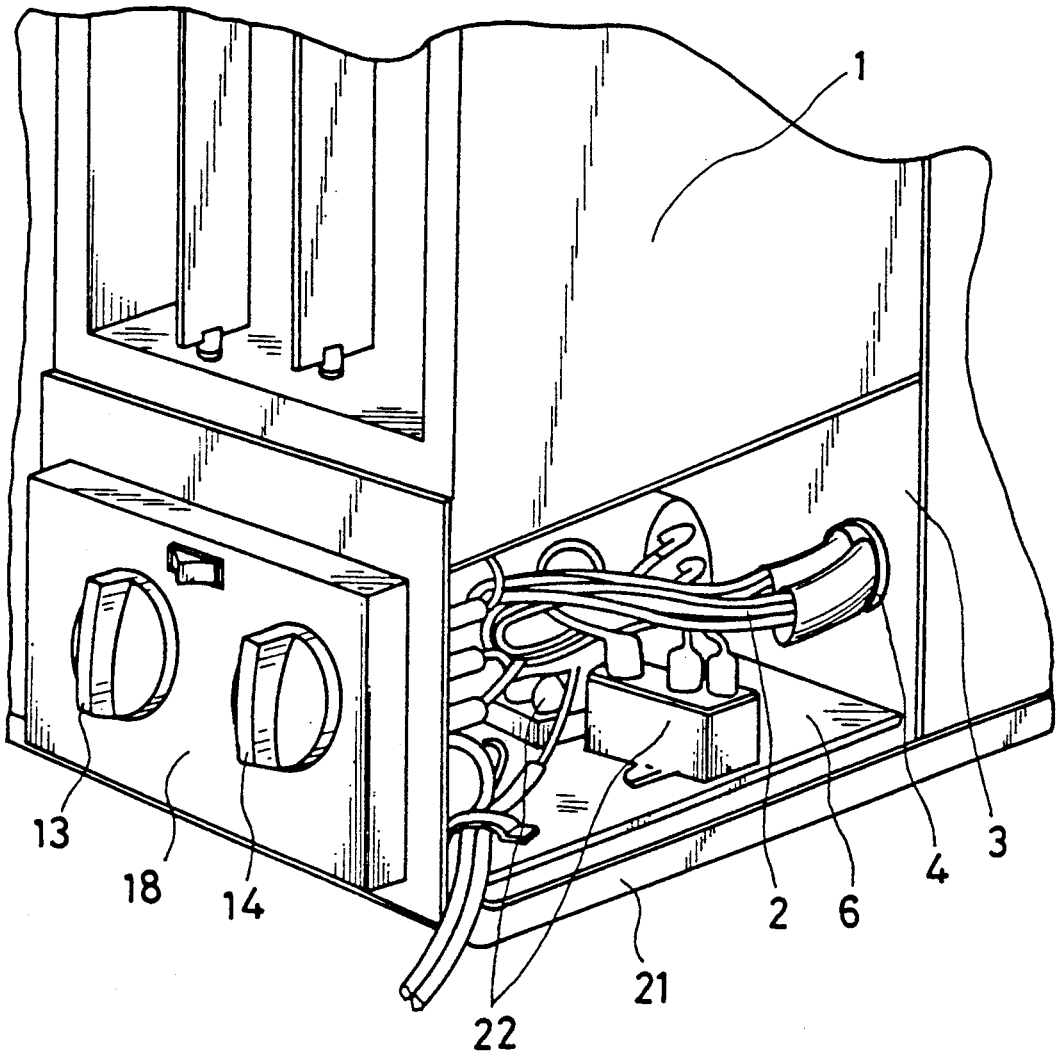
FIG. 4 (Prior Art)
FIG. 4 shows a partial perspective view of the conventional control box of the box-shaped air conditioner.

Hereafter a preferred embodiment of the present invention is explained with reference to the accompanying drawings. FIG. 1 is a perspective view partly in section of a first embodiment of an integral air conditioner having a control box that may be drawn out. FIG. 2 is an exploded perspective view of the removable control box 6. FIG. 3(*a*) is a plan view of the control box 6 which is mounted in a body 1 of an air conditioner. FIG. 3(*b*) is a plan view of the control box 6 when drawn out from the body 1 of the air conditioner. In FIGS. 1, 2 and 3, the body 1 of an air conditioner contains a compressor 19, a fan motor (not shown), and a control box 6, whereto lead wires 2 from the compressor 19 and the fan are led in for interconnection through electric control devices. The lead wires 2 are led into the control box 6 through a hole 4 formed on a bulkhead 3 into the control box 6. The lead wires are bundled or are formed into a cable and fixed to a frame 21 of the body 1 by a clamp member 5. The lead wires 2 are folded twice or more and contained in lead wire compartment 6A in the control box 6. Ends of the lead wires 2 are again folded and led into an electric component compartment 6B through a gap 37 between the rear end of a partition plate 7 and the bulkhead 3. In the electric component compartment 6B, another end parts of bundled lead wires 2 are fixed on a bed plate **6*d* of the control box by a clamp member 8. And ends of lead wires 2 are connected with terminals set in the electric component compartment 6B**.

As shown in more detail in FIG. 2, both the upper part and lower part of the partition plate 7 are bent rectangularly to form bent portions **7*a* and 7*b*, which are used in the below-mentioned connection with respect to a cover 6*c* and the bed plate 6*d*. Hooks 9, 9 are formed by cutting and raising a part of the bed plate 6*d*. A hole 10 is formed on the bent portion 7*b*. These hooks 9, 9 are fixed into the hole 10 and edge 7*b'* of bent portion, and the bed plate 6*d* is slightly slid to insert bent portion 7*b* into hooks 9, 9. Thus the partition plate 7 is connected with the bed plate 6*b*. The cover 6*c* is connected with the bent portion 7*a* by a conventional screw 12. Connection between the cover 6*c* and the bed plate 6*d*** is made in a conventional way, which is not elucidated.

As shown in FIGS. 3(*a*) and 3(*b*), electric components such as printed board **11*b*** and connection terminal 11*c* are mounted on the surface of the partition plate 7 at the side of electrical component compartment 6B. And other electric components such as a selecting switch 13 and a control switch 14 are mounted on a switch board 18, which is fixed to the front end of the bed plate 6*d*.

Now, operation of drawing out and pushing in the control box 6 is elucidated. When the control box 6 is drawn out from the body 1 for maintenance or the like, since the body 1 having a heavy compressor motor, etc. thereon is very heavy and the body 1 is fixed to a window frame of a house (not shown in FIGS.), only the control box 6 is drawn forward out of the front part of the body 1. As the control box 6 is drawn out, the folded part of lead wires 2 between the clamp members 5 and 8 is extended. Only the part of the lead wires 2 between the two folded part 22 and 23 is moved. The lead wires 2 at the part between the folded part 23 and the ends connected to respective electronic components does not move, since this part is fixed by the clamp member 8. Thus lead wires 2 never catch or hook up with any electric components, and hence the wires never damage or disconnection from their terminals.

When the control box 6 is pushed and set in the body 1, the part of lead wires 2 between the clamp members 5 and 8 is folded again in the lead wire compartment 6A in the same manner as before the drawing out of the control box 6, owing to elastic force of the lead wires 2 to restore the original folded shape. Therefore, the part of the lead wires 2 between the connected ends to the electric components 11*b*, 11*c* and the clamp member 8 does not move at all. Accordingly, there is no fear of catching of the electric component by the lead wires 2. Thus, there is no damage to the electric components 11*b*, 11*c* or their connections.

Since the electric components such as a printed board 11*b* and a terminal 11*c* are mounted on the surface of the partition plate 7 at the side of the electric component compartment, the partition plate 7 gives useful and effective utilization of space for mounting the electric components, and good cooling of them is possible since they are mounted on the vertical printed board.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An integral type air conditioner comprising a control box which is provided in a manner to be drawn out in a given direction from a front end of a body, wherein the control box comprises:

an electrical component compartment containing electrical components, a wire compartment having an opening at least at a rear side, a partition extending parallel to said direction to part said electrical component compartment and said wire compartment, and electrical wires leading from said body and being connected to said electrical components, said wires having a length sufficient to remain connected when said control box is drawn a predetermined amount out of said body and being folded into said wire compartment when said control box inside said body.

2. An air conditioner in accordance with claim 1 wherein;

at least an electric component is mounted on a surface of said partition at the side of said electric component compartment.

3. An air conditioner in accordance with claims 1 or 2 including:

means for mounting said wires to said body and in said electrical component compartment for folding said wires at least once in said wire compartment and at least once at a rear end of said partition when said control box is inside said body.

4. An integral type air conditioner having a removable control box, said control box being located in a front end of a body of the air conditioner, said control box comprising:

an electrical component compartment containing electrical components of the air conditioner;

lead wires from the electrical components, said lead wires being bundled together in a bundle having first and second ends, said second end being joined with elements within said air conditioner;

means for holding the bundle located proximate the first end of said bundle, said holding means being disposed in a rear section of said electrical component compartment; and a lead wire compartment juxtapose to said electrical component compartment, and a partition separating said lead wire compartment from said electrical component compartment;

wherein said lead wire compartment is disposed so that when said control box is in a closed position in said air conditioner, said bundle bends so that it is positioned substantially within the lead wire compartment; and wherein said bundle extends substantially straight when said control box is removed from said air conditioner.

5. An air conditioner as claimed in claim 4, wherein said bundle is clamped to an interior wall of said body, said interior wall forming a side wall of said lead wire compartment when said control box is in its closed position.

6. An air conditioner as claimed in claim 4, wherein said partition is disposed substantially parallel to a direction of removal of the control box from the air conditioner body.

7. An integral type air conditioner comprising:

a control box, a receiving compartment in said air conditioner for receiving said control box, said control box being moveable into and out of said receiving compartment in a given direction, said control box having a first compartment containing electrical components and divided therefrom a second compartment which extends in said given direction, a cable of electrical wires connected to at least some of said electrical components and extending deeply into said receiving compartment, and means for mounting said cable in both said receiving compartment and said first compartment to cause said cable to be folded into said second compartment as said control box is moved into said receiving compartment and to allow said cable to be extended intact with said some electrical components without damaging any of said electrical components when said control box is moved out of said receiving compartment.

8. An air conditioner as in claim 7 wherein:

said first and second compartments are divided by a partition extending in said given direction, said receiving compartment has a wall which extends in said given direction and for said second compartment forms a wall opposite said partition when said control box is inside said receiving compartment, and wherein said mounting means fixes said cable to said first compartment and spaced therefrom to said wall at a predetermined point between opposite ends of said wall to cause said cable to fold around said partition and into said second compartment and to fold again near said predetermined point.

* * * * *